US005881440A

United States Patent [19]

Deeming et al.

[11] Patent Number: 5,881,440

[45] Date of Patent: Mar. 16, 1999

[54] NON-WOVEN FABRIC MANUFACTURE

[75] Inventors: Robert Michael Deeming, Nuneaton; John Eric Arden, Burbage, both of United Kingdom

[73] Assignee: Courtaulds Engineering Limited, Coventry, United Kingdom

[21] Appl. No.: 945,688

[22] PCT Filed: May 1, 1996

[86] PCT No.: PCT/GB96/01046

§ 371 Date: Dec. 2, 1997

§ 102(e) Date: Dec. 2, 1997

[87] PCT Pub. No.: WO96/35835

PCT Pub. Date: Nov. 14, 1996

[30] Foreign Application Priority Data

May 3, 1995 [GB] United Kingdom ..... 9508995

[51] Int. Cl.[6] ..... D04H 1/46

[52] U.S. Cl. ..... 28/104; 28/167

[58] Field of Search ..... 28/103, 104, 105, 28/106, 107, 108, 109, 110, 111, 167; 26/1; 198/626.1, 626.2, 804

[56] References Cited

U.S. PATENT DOCUMENTS

| | | |
|---|---|---|
| 2,862,251 | 12/1958 | Kalwaites . |
| 3,679,536 | 7/1972 | Kalwaites . |

FOREIGN PATENT DOCUMENTS

| | | |
|---|---|---|
| 0 333 210 | 9/1989 | European Pat. Off. . |
| A 38 02 572 | 8/1989 | Germany . |
| 1 380 613 | 1/1975 | United Kingdom . |
| 1 534 979 | 12/1978 | United Kingdom . |
| A 2 975 483 | 4/1982 | United Kingdom . |

*Primary Examiner*—Michael A. Neas
*Assistant Examiner*—Larry D. Worrell, Jr.
*Attorney, Agent, or Firm*—Nixon & Vanderhye P.C.

[57] ABSTRACT

A method and apparatus for processing fibrous material into a web (15) of hydroentangled nonwoven fabric, the web (15) passing through an apparatus (11) comprising high pressure jets (51) and drums (31) (32) and rollers (41). The web (15) is initially passed through the apparatus by guide tapes (62) (63) which pass through the apparatus in parallel with the web, and holds the web (15) on one front lateral edge only during the initial pass of the web through the apparatus.

10 Claims, 4 Drawing Sheets

NON-WOVEN FABRIC MANUFACTURE

BACKGROUND OF THE INVENTION

1. Field of the Invention

The present invention concerns a method and apparatus for manufacturing non-woven fabric.

2. Discussion of the Prior Art

It is well known to manufacture non-woven fabric by introducing fibrous material onto a support and then treating the fibrous material by means of high pressure liquid jets, typically water jets. This treatment causes the individual fibres to entangle with each other within the fibrous web and compacts the fibres to form a paper-like non-woven material. Such a method is known as "hydroentanglement" and is described in U.S. Pat. No. 3,485,706 and U.S. Pat. No. 3,508,308.

In hydroentanglement processes it is known for the liquid jets to be directed onto a fibrous web carried on a wire screen which is supported on a high open area cylindrical drum (see U.S. Pat. No. 5,042,722). A typical process path through hydroentanglement apparatus can involve a passage around a plurality of rollers and drums. A problem associated with such apparatus is the initial feed-through of the fibrous sheet, which can be extremely difficult to achieve and is typically accomplished manually.

SUMMARY OF THE INVENTION

The present invention provides a method and apparatus of automatically initially feeding the fibrous web in a hydroentanglement apparatus.

According to one aspect of the invention there is provided a method of manufacturing a non-woven fabric in which a web of fibrous material is entangled using high pressure liquid jets, the fibrous web passing through an apparatus having a tortuous process path around a plurality of drums and/or rollers over which the web is transported, whereby the fibrous web is initially passed through the apparatus by attaching a front portion of the web to at least one belt means which passes through the apparatus in parallel with the fibrous web for at least a portion of the tortuous process path, so that the belt means pulls the web through the process path, characterised on that the front portion of the fibrous web is held on one lateral edge only by the belt means as the web makes its initial pass through the apparatus.

The belt means includes an endless belt which preferably circulates continuously through the apparatus.

According to another aspect of the invention there is provided an apparatus for processing fibrous material into a web of non-woven fabric by entanglement of fibres using high pressure liquid jets, the apparatus including jet heads directing jets of liquid onto a web of fabric being transported through the apparatus by a plurality of drums and/or rollers around which the web passes during a tortuous process path through the apparatus, wherein the apparatus is further provided with at least one feed belt means, which passes through the apparatus in parallel with the fibrous web for at least a portion of the process path, the web being attachable to the feed belt means in order to feed the web through said rollers and drums, the belt means being arranged on one lateral side of the fibrous web, so that said one side of the fibrous web can be attached to the belt means. Conveniently the belt means comprises high and lower endless tapes which are superimposed one on the other for at least a portion of their path through the apparatus the fibrous web being held between the two tapes for guiding the web through the apparatus.

BRIEF DESCRIPTION OF THE DRAWINGS

Embodiments of the invention will now be described, by way of example only and with particular reference to the accompanying drawings, in which.

DETAILED DISCUSSION OF PREFERRED EMBODIMENT

Figure 1:
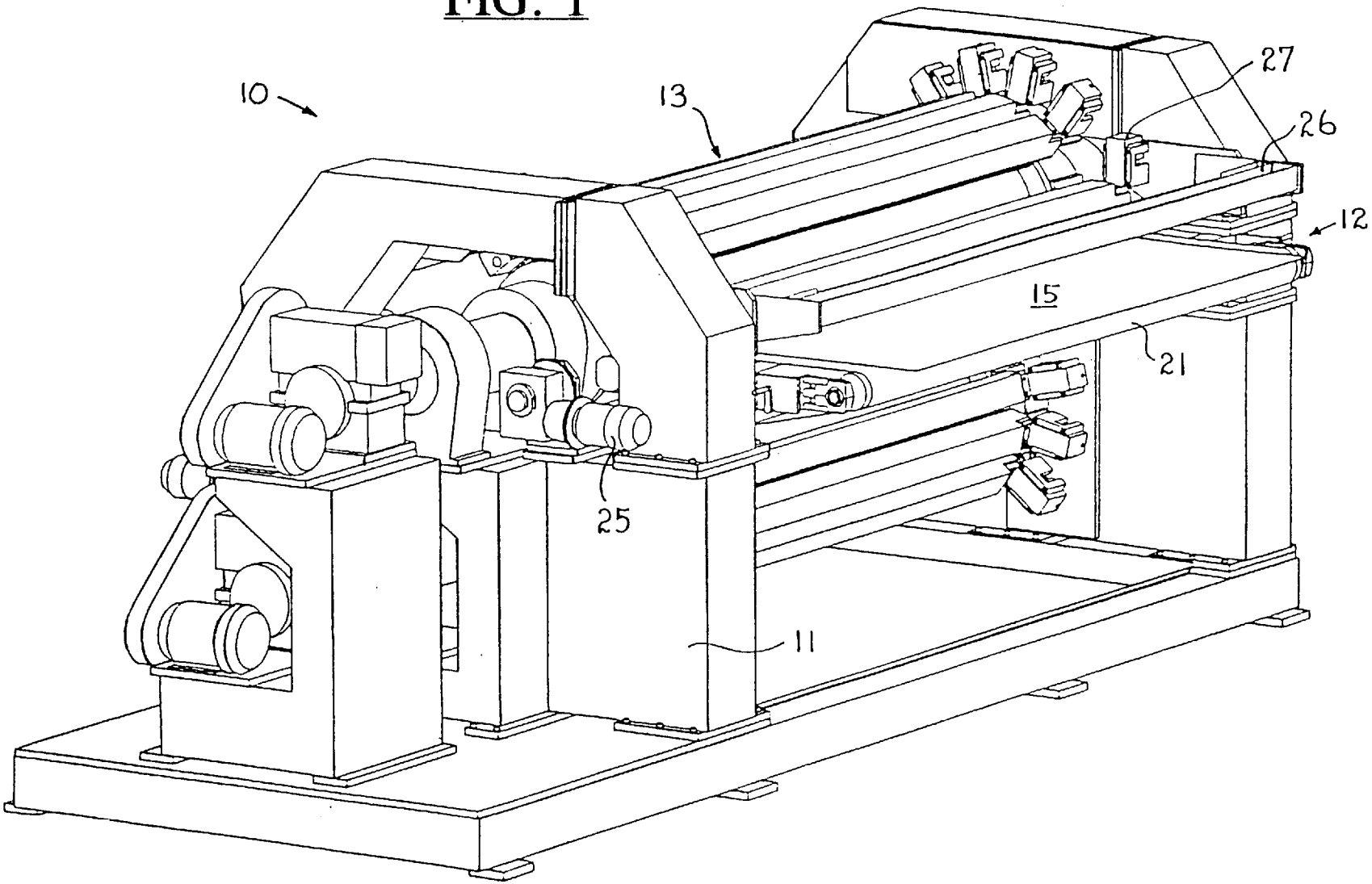
FIG. 1 is an upstream isometric view of an apparatus for the hydroentanglement of fibrous material to which an endless feed belt can be fitted.

FIG. 1 of the drawings shows an hydroentanglement apparatus 10 which includes a machine frame 11 on which is supported a plurality of rollers, drum and belts etc. In particular the apparatus includes an initial feed conveyor 12 which feeds a web 15 of loosely interconnected fibres into the apparatus, a hydroentanglement section 13, and a take-off section (which cannot be seen in FIG. 1) for the removal of hydroentangled non-woven fabric.

The feed conveyor 12 comprises an endless porous mesh belt 21 which circulates around spaced rollers, the inner roller of which is a drive roller rotated by motor 25. Arranged above and transversely to the feed conveyor 12 there is a water reservoir with a weir 26 which deposits a continuous curtain of water onto the web of fibres for initial wetting and compaction. A low pressure jet head 27 extending transversely of the conveyor 12 is located immediately downstream of the reservoir/weir 26. Water is delivered to the jet head 27 at a pressure of about 25 bar to provide further compaction and partial entanglement of the fibres to give cohesion to the incoming fibre web 15.

Figure 2:
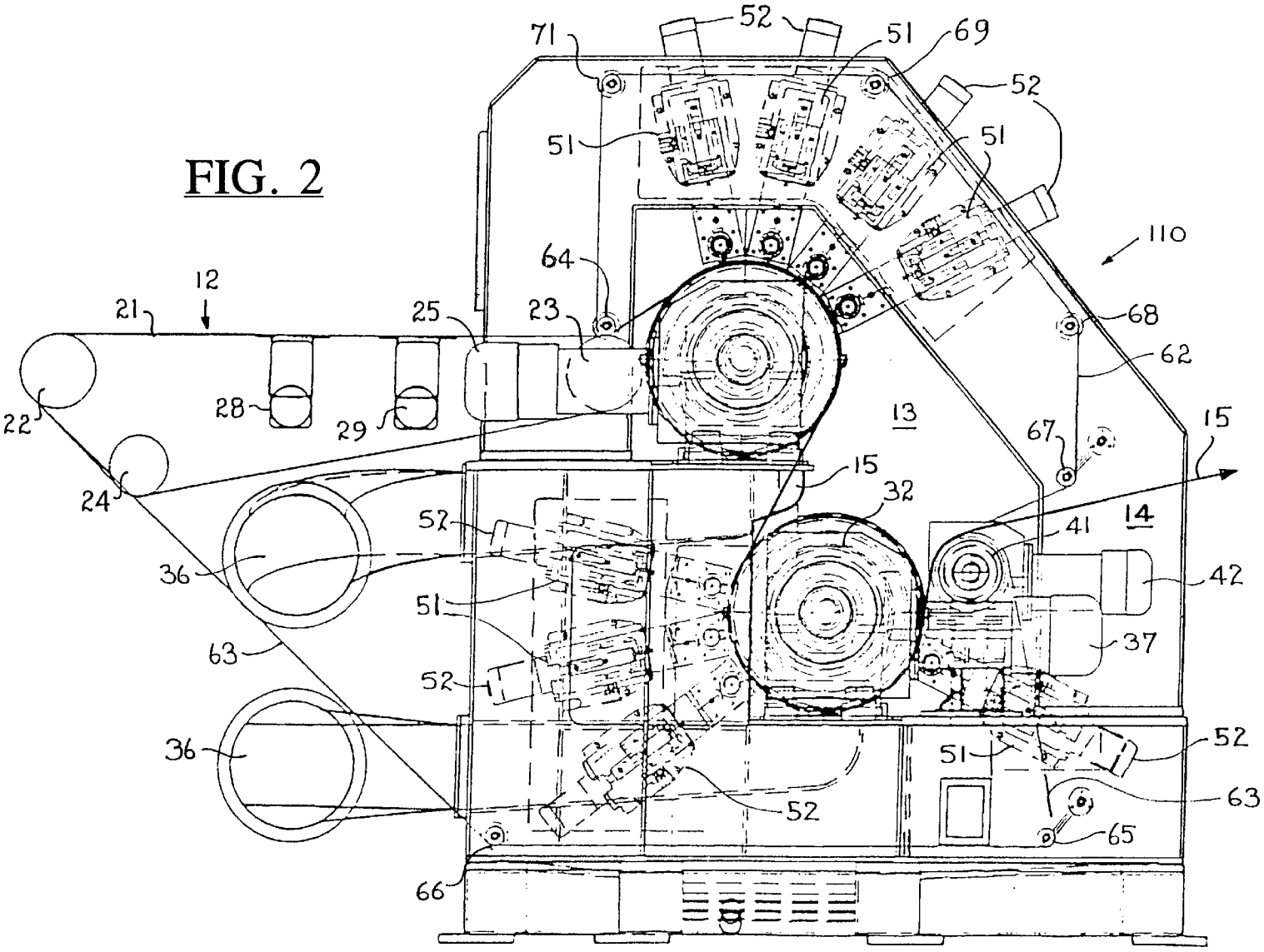
FIG. 2 is a section through an apparatus according to the present invention, and which is substantially identical to the apparatus of FIG. 1 and further includes the endless feed belt.
Figure 3:
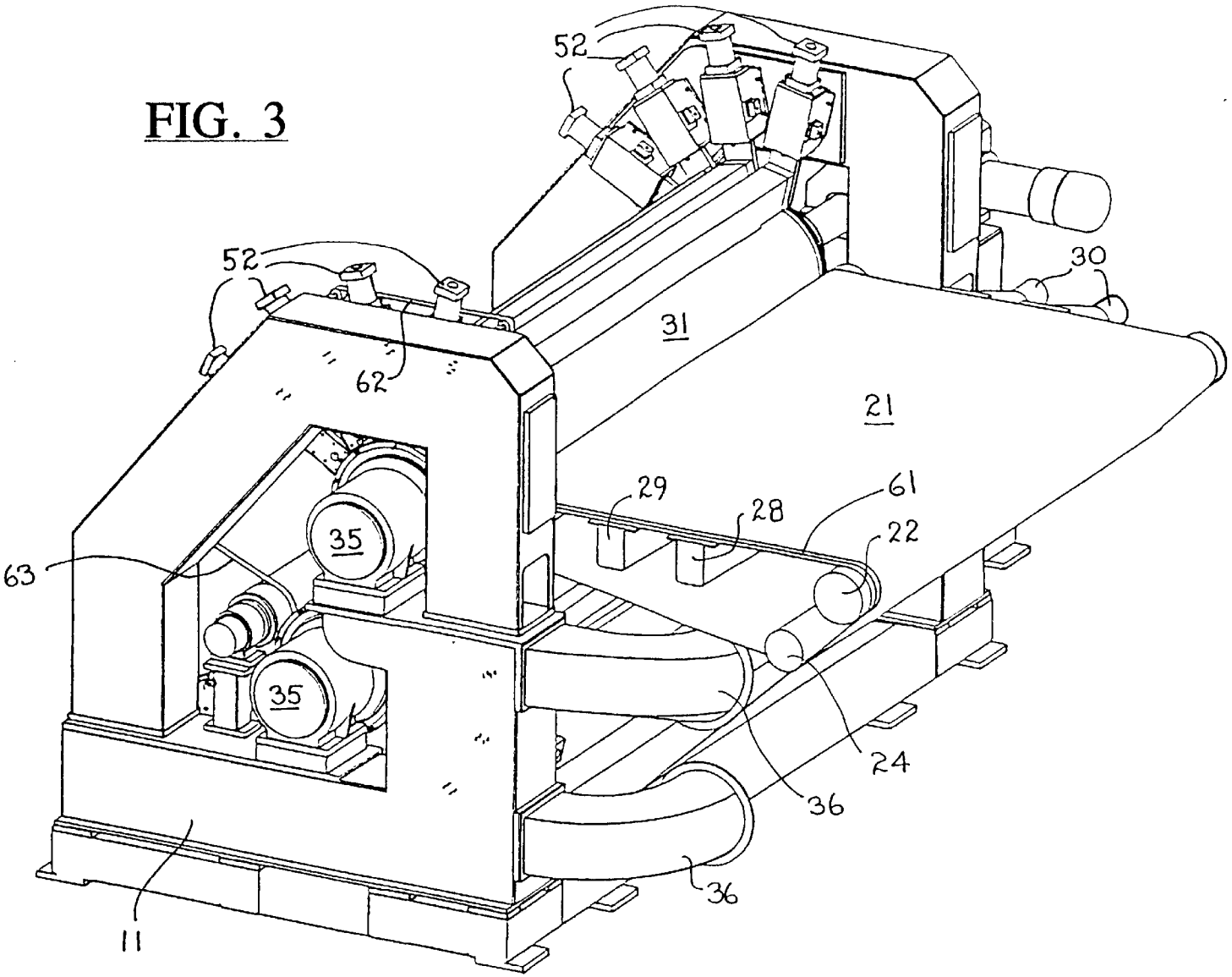
FIG. 3 is a upstream isometric view of the apparatus of FIG. 2.
Figure 4:
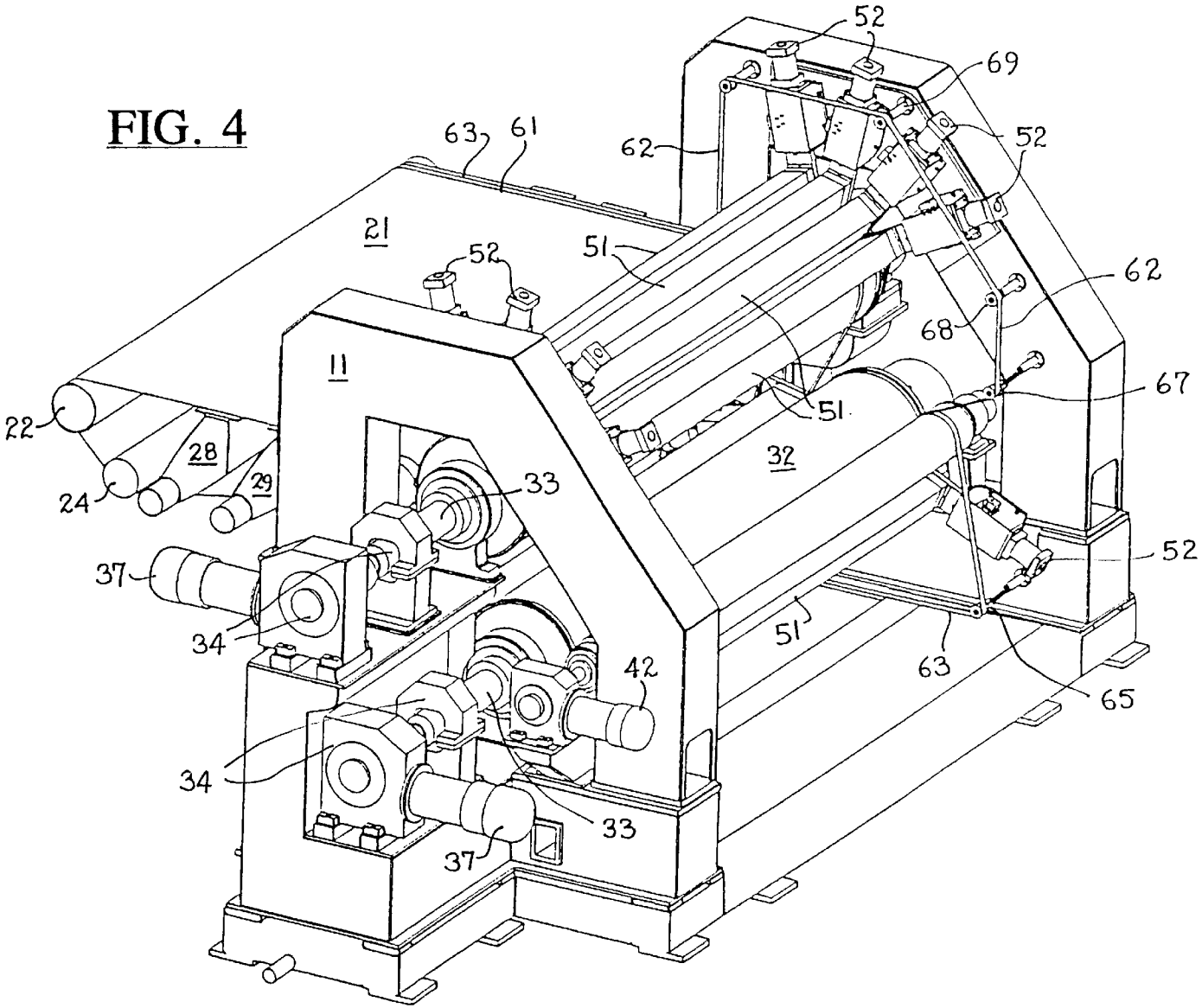
FIG. 4 is a downstream isometric view of the apparatus of FIG. 2.

The feed conveyor 12 with accompanying prewetting weir 26 and low pressure head 27 can also be utilised in second similar apparatus 110 shown in FIGS. 2 to 4 in which apparatus similar reference numerals have been used as in the apparatus shown in FIG. 1 to identify similar parts.

The hydroentanglement apparatus 110 has a feed conveyor 12, a hydroentanglement section 13, and a take-off section 14. A feed conveyor endless belt 21 passes around spaced rollers 22, 23 and 24. The inner roller 23 is a drive roller which is rotated by motor 25 which causes the belt to circulate continuously. The upper flight of the belt 21 passes over a pair of vacuum chests 28,29 which are arranged substantially in alignment with the weir 26 and the low pressure jet head 27. The vacuum chests 28,29 are connected by conduits 30 to a vacuum source for removal of water from the feed conveyor 12.

A pair of drums 31, 32 is mounted in the frame 11 with their axes parallel, the drum 31 being arranged to receive the fibrous web 15 from the feed conveyor 12 and the other drum 32 being located below the first drum 31 and off-set therefrom so as not to be vertically below the first drum.

Each of the two drums 31, 32 is formed from a perforated corrosion resistant material, e.g. stainless steel, which is further enclosed in a support mesh with an outer porous sleeve made from fine woven wire mesh, preferably of stainless steel wire. Each drum 31, 32 is mounted on a separate axle 33. Each axle 33 is supported at one end in a pair of axially spaced roller type bearings 34 so that each drum 31, 32 may be cantilevered from the frame 11 by the pair of bearings 34. The other ends of the drums 31 and 32 are supported on the frame 11 by removable bearing caps 35, which support the drum axles 33 for rotation, but can be removed to allow the drums to be cantilevered at the respective other end of the axles by the bearings 34 to facilitate sleeve and mesh removal from the drums during maintenance.

The interiors of the drums 31, 32 have static vacuum chambers for removal of water from the drums which are connected to a vacuum pump, air/water separator recirculation system (not shown) via flues 36. The vacuum chests 28,29 may also be connected to the flues 36.

The drums 31 and 32 are driven by motors 37 which are synchronised to ensure that the drum 31 rotates at a slightly higher linear surface speed than the belt 21, and that the drum 32 rotates at a slightly higher linear surface speed than the drum 31, thereby maintaining the web 15 under tension as it moves through the apparatus. The drums 31, 32 and the feed conveyor belt 21 are synchronised so that their speed ratios remain constant so that changing speed for one drum causes a speed change to the other drum and the belt.

The take-off section of the apparatus comprises a high vacuum roller 41 mounted in the frame for rotation and which is driven by motor 42 which is also synchronised with the drums 31, 32 and feed conveyor 12. The hydroentangled fibre web 15 is removed from the high vacuum roller 41 and then taken to a drier (not shown).

Radially outwardly of each drum 31, 32 there is arranged a plurality of high pressure jet heads 51 which receive water at a high pressure (between 200–350 bar) and direct high pressure jets of water onto the surface of the drums 31, 32. For manufacture of high density non-woven fabrics (up to 350 $gm^2$) it may be necessary to have up to four jet heads 51 arranged around each drum 31, 32. The jet heads 51 are described in our copending British patent application 9418833.1, and may be mounted on the frame 11 so that the distance between each head and the respective drum 31, 32 can be varied. The jet heads 51 are mounted at each end thereof to actuators 52 fixed to the frame 11. The actuators 52 are preferably pneumatic actuators which provide for radial movement relative to the drums 31, 32 of the respective jet head 51 for adjustment of the height of the head 51 above the drum. The high pressure jets from the heads 51 perform the hydroentanglement operation by impacting on the fibrous web, and also by rebound from the surface of the drums.

In use, the fibrous material is deposited onto the upper flight of the feed conveyor belt 21 and is transported towards the upper hydroentanglement drum 31. The partially entangled web 15 then passes clockwise, as shown in FIG. 2, around the upper drum 31 with one side of the web 15 exposed to the hydroentanglement jets. The web 15 then transfers to the lower drum 32 to pass anti-clockwise, as shown in FIG. 2, around the second drum 32 and expose the other side of the web to the hydroentanglement jets. The web then passes clockwise over the high vacuum roller 41 to remove water from the web 15 and then on to a drier (not shown).

The process path taken by the fibrous web 15 as it passes through the entanglement apparatus is tortuous and can cause difficulties when initially feeding the web 15 through the apparatus.

In order to overcome these difficulties the apparatus is provided with at least one feed belt means 61 which passes through the apparatus for at least part of the process path in parallel with the fibrous web 15. In the preferred embodiment the belt means 61 comprises first and second endless tapes 62, 63 which are superimposed one on the other for at least a portion of the process path through the apparatus. The belt means 61 is preferably arranged to one lateral side only of the apparatus, although belt means 61 could be arranged on each lateral side if required.

The endless lower tape 63 is arranged in parallel with the upper flight of the feed belt 21 and passes beneath a roller 64 arranged above the feed belt drive roller 23. The tape 63 then passes clockwise around the higher entanglement drum 31, anticlockwise around the lower entanglement drum 32 and clockwise around the high vacuum roller 41. After the high vacuum roller 41, the tape 63 travels downwards to a roller 65, then horizontally back towards a roller 66 and then upwardly to the feed belt roller 21.

The upper endless tape 62 passes around the roller 64 above the tape 63 and is then superimposed on the tape 63 until the combined tapes reach the high vacuum roller 41. Thereafter the two tapes 62, 63 diverge. The higher tape 62 travels upwardly passing over rollers 67,68, horizontally back towards roller 71 and then downwardly to the roller 64.

The two tapes 62,64 move around their respective endless paths constantly even when not in use.

In use a leading edge portion of a partially entangled fibrous web 15 is slipped between superimposed tapes 62, 63 at the nip between rollers 23 and 64. This can be achieved by folding a leading portion of the web back across itself so that it extends over one side edge of the web and can be inserted between the tapes 62,63 passing along that edge. The fibrous web 15 is then gripped between the two tapes which pull it through the apparatus to the point where the tapes 62, 63 diverge. Thus, having guided the web 15 through the apparatus, the tapes automatically release the web 15 which can be fed by hand to a storage roller.

I claim:

1. A method of manufacturing a non-woven fabric in which a web of fibrous material is entangled using high pressure liquid jets, the fibrous web passing through an apparatus having a tortuous process path, said path passing at least partially around at least two drums wherein one drum contacts an upper surface of said web and the other drum contacts a lower surface of said web, whereby the method comprises the steps of;

providing at least two tapes, each of said tapes having a width less than a width of said webs said tapes at least passing along at least a portion of said path in parallel; and passing said fibrous web through the apparatus by sandwiching at least one lateral edge of said web between said tapes said tapes and said sandwiched web passing along at least a portion of said tortuous process path, so that the web is held by the tapes which guide the web during at least an initial pass of the web through the apparatus.

2. A method as claimed in claim 1, wherein said tapes comprise a pair of endless belts which follow separate paths but which are superimposed one on the other in a common path for at least a portion of said path.

3. A method as claimed in any one of claims 1, wherein tapes are continuously passing through the apparatus whilst the web is being processed.

4. A method as claimed in claim 1 claims, wherein said tapes automatically detach from the front portion of the web after the fibrous web has passed through the tortuous process path in the apparatus.

5. Apparatus for processing a web of fibrous material into non-woven fabric by entanglement of fibres using high pressure liquid jets, said web having two surfaces, the apparatus comprising:

at least two drums, said at least two drums defining a tortuous processing path for said web, wherein one of said drums at least partially contacts said web on one of said surfaces and the other of said drums at least partially contacts said web on the other of said surfaces along said path jet heads directing jets of liquid onto each of said surfaces of said web;

at least two tapes passing along said path, each of said tapes having a width less than a width of said web, said tapes sandwiching at least one lateral edge of said webs said tapes and said web sandwiched therebetween in combination passing along at least a portion of said path during an at least initial pass of said web in said apparatus.

6. Apparatus as claimed in claim 5 wherein said tapes comprise first and second endless tapes which are superimposed one on the other for at least a portion of said path through the apparatus, the with said fibrous web being held between portions of the two tapes.

7. Apparatus for processing a web of fibrous material into non-woven fabric by entanglement of fibres using high pressure liquid jets, said web having two surfaces, said apparatus comprising:

at least two drums, said at least two drums defining a tortuous processing path for said web, wherein one of said drums at least partially contacts said web on one of said surfaces and the other of said drums at least partially contacts said web on the other of said surfaces along said path jet heads directing jets of liquid onto each of said surfaces of said web;

at least two tapes passing along said path, each of said tapes having a width less than a width of said web, said tapes sandwiching at least one lateral edge of said web, said tapes and said web sandwiched therebetween in combination passing along at least a portion of said path, a substantially horizontal conveyor belt onto which the fibrous material is deposited, a pre-wetting weir which initially compacts the fibres; and a low pressure jet head immediately downstream of the weir for partial entanglement of the fibres, the conveyor belt being adapted to feed the wetted fibrous material directly onto at least one porous drum onto which said high pressure liquid jets are directed.

8. Apparatus as claimed in claim 7, wherein the first and second endless tapes converge at a location in the process path between the low pressure jet head and said one porous drum.

9. Apparatus as claimed in claims 7, wherein the apparatus further includes at least one vacuum roller for removing excess liquid from the fibrous web arranged downstream of said at least one drum.

10. Apparatus as claimed in claim 9, wherein the two endless tapes diverge downstream of the vacuum roller thereby automatically releasing the fibrous web after guiding said web through the apparatus.

* * * * *